US007356890B1

(12) United States Patent
Sauder

(10) Patent No.: US 7,356,890 B1
(45) Date of Patent: Apr. 15, 2008

(54) CASKET LEVELING BED

(75) Inventor: Myrl D. Sauder, Archbold, OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 11/879,366

(22) Filed: Jul. 17, 2007

(51) Int. Cl.
*A61G 17/00* (2006.01)

(52) U.S. Cl. ..... 27/12; 5/11

(58) Field of Classification Search ..... 27/12; 5/11, 610–612; D99/8
See application file for complete search history.

(56) References Cited

U.S. PATENT DOCUMENTS

| | | | | | |
|---|---|---|---|---|---|
| 1,610,781 | A | | 12/1926 | Hollins | |
| 2,051,163 | A | * | 8/1936 | Corrigan | 27/12 |
| 2,230,433 | A | * | 2/1941 | Pinto | 27/12 |
| 2,636,246 | A | * | 4/1953 | Quaka | 27/12 |
| 2,670,517 | A | * | 3/1954 | Hillenbrand et al. | 27/12 |
| 2,729,875 | A | * | 1/1956 | White | 27/12 |
| 2,839,814 | A | * | 6/1958 | Harter | 27/12 |
| 2,848,781 | A | * | 8/1958 | Slaughter, Jr. et al. | 27/12 |
| 2,888,732 | A | * | 6/1959 | Nelson | 27/12 |
| 3,041,704 | A | * | 7/1962 | Gruber | 27/12 |
| 3,065,516 | A | * | 11/1962 | Dower | 27/12 |
| 3,490,114 | A | | 1/1970 | Connelly | |
| 3,653,104 | A | * | 4/1972 | Nelson | 27/12 |
| 3,692,267 | A | * | 9/1972 | Kronas et al. | 248/288.11 |
| 3,835,509 | A | | 9/1974 | Esterdahl | |
| 3,879,818 | A | | 4/1975 | Rowland | |
| 3,924,309 | A | | 12/1975 | Andrus, Jr. et al. | |
| 3,962,761 | A | | 6/1976 | Boughner | |
| 4,070,737 | A | * | 1/1978 | Peterson | 27/12 |
| 4,332,064 | A | * | 6/1982 | Foust | 27/12 |
| 4,403,380 | A | * | 9/1983 | Hazelett et al. | 27/12 |
| 4,524,472 | A | * | 6/1985 | Foust | 5/611 |
| 4,621,395 | A | * | 11/1986 | Benoit | 27/12 |
| 4,881,306 | A | | 11/1989 | Ernat et al. | |
| 4,930,197 | A | | 6/1990 | McClive | |
| 4,993,129 | A | * | 2/1991 | Underwood et al. | 27/12 |
| 5,153,960 | A | | 10/1992 | Ritter et al. | |
| 5,231,741 | A | * | 8/1993 | Maguire | 27/12 |
| H1348 | H | | 9/1994 | Linville et al. | |
| 5,499,886 | A | | 3/1996 | Short et al. | |
| 5,570,493 | A | | 11/1996 | Gulick | |
| 5,592,724 | A | | 1/1997 | Linville et al. | |
| 5,615,464 | A | | 4/1997 | Rojdev | |
| 5,709,016 | A | | 1/1998 | Gulick et al. | |
| 5,765,268 | A | | 6/1998 | MacKirdy | |
| 6,018,853 | A | | 2/2000 | Chen et al. | |
| 6,151,762 | A | | 11/2000 | Cox | |
| 6,179,515 | B1 | | 1/2001 | Grieser et al. | |
| 6,301,758 | B1 | | 10/2001 | Biondo et al. | |
| 6,434,804 | B1 | | 8/2002 | Cornet et al. | |
| 2002/0194714 | A1 | | 12/2002 | Cornet et al. | |
| 2005/0060854 | A1 | | 3/2005 | Cornet et al. | |

* cited by examiner

*Primary Examiner*—William L. Miller
(74) *Attorney, Agent, or Firm*—MacMillan, Sobanski & Todd, LLC

(57) ABSTRACT

A leveling bed assembly for a casket includes a support member having a first end and a second end. The support member pivots allowing the first end of the support member to be raised from a level position to a raised position. A support stop is in contact with the second end of the support member. A spring member is attached to the first end of the support member. The spring member flexes when the first end of the support member is in the raised position. A post supports the flexed spring member in the raised position.

15 Claims, 3 Drawing Sheets

CASKET LEVELING BED

TECHNICAL FIELD

The invention relates generally to caskets. More specifically, the invention is directed to a leveling bed for a casket.

BACKGROUND OF THE INVENTION

Caskets are used for the interment of the bodies of deceased persons. Before interment, the body of the deceased is typically displayed for the benefit of loved ones at a funeral. When the body is displayed, it is highly desirable that the body be presented within the casket in a respectful manner. According, the upper torso and head of the deceased is often raised so that the body can be easily viewed. When the viewing of the body is completed, the upper torso and head of the body are lowered to a level position within the casket.

Within the casket, the body of the deceased rests on a bed. Raising and lowering the upper torso and head of the body is accomplished by raising and lowering a portion of the bed. Raising and lowering of a portion of the bed should be accomplished quickly and with a minimum of effort. Raising and lowering of a portion of the bed should also be accomplished with minimum disruption to the body of the deceased. Further, raising and lowering of a portion of the bed should be accomplished by a cost effective mechanism. The invention provides such a casket leveling bed.

SUMMARY OF THE INVENTION

A leveling bed assembly for a casket includes a support member having a first end and a second end. The support member pivots allowing the first end of the support member to be raised from a level position to a raised position.

A support stop is in contact with the second end of the support member.

A spring member is attached to the first end of the support member. The spring member flexes when the first end of the support member is in the raised position.

A post supports the flexed spring member in the raised position.

DETAILED DESCRIPTION OF THE INVENTION

Figure 1:
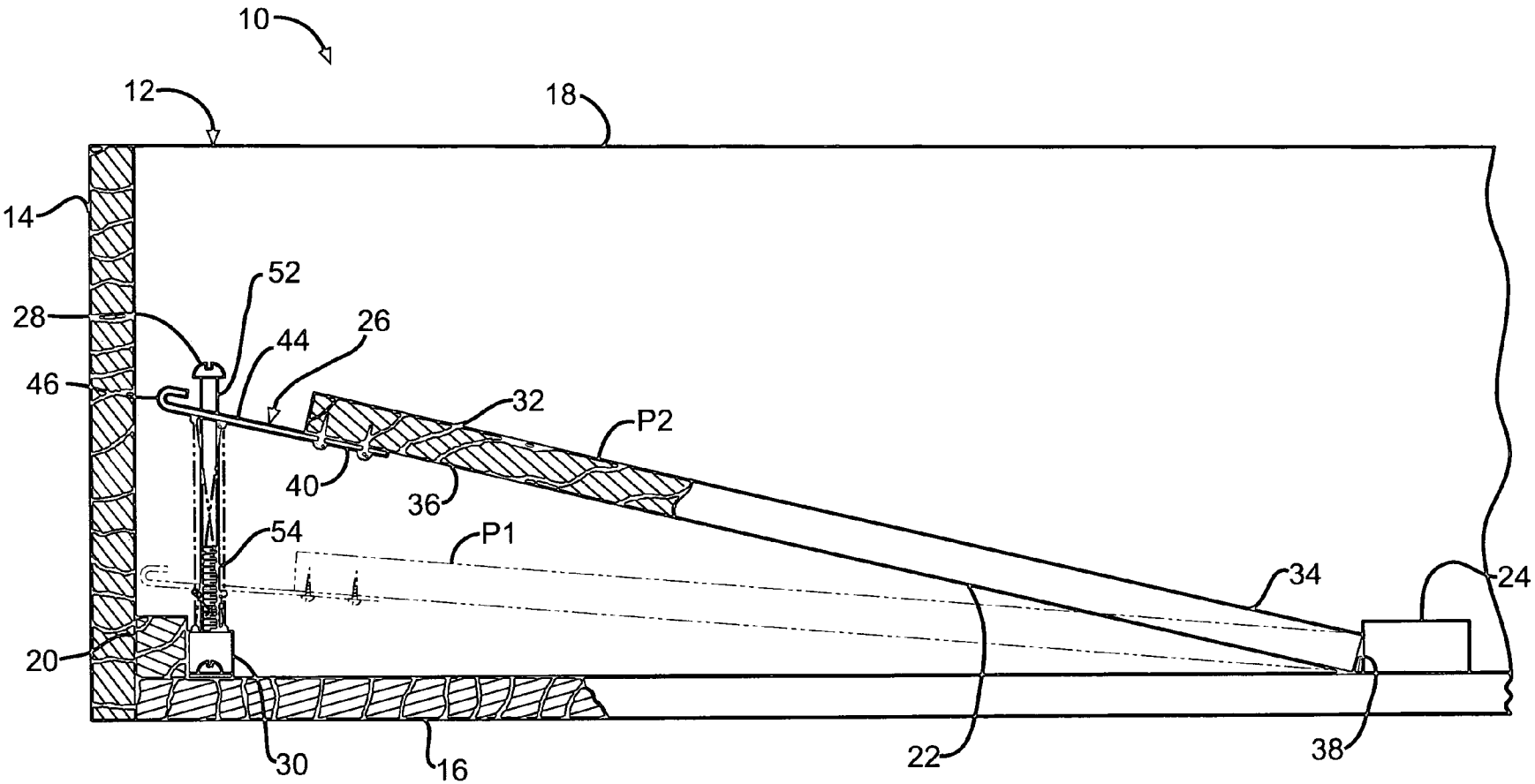
FIG. 1 is a front view, partially in cross section, of a casket leveling bed according to the invention.
Figure 2:
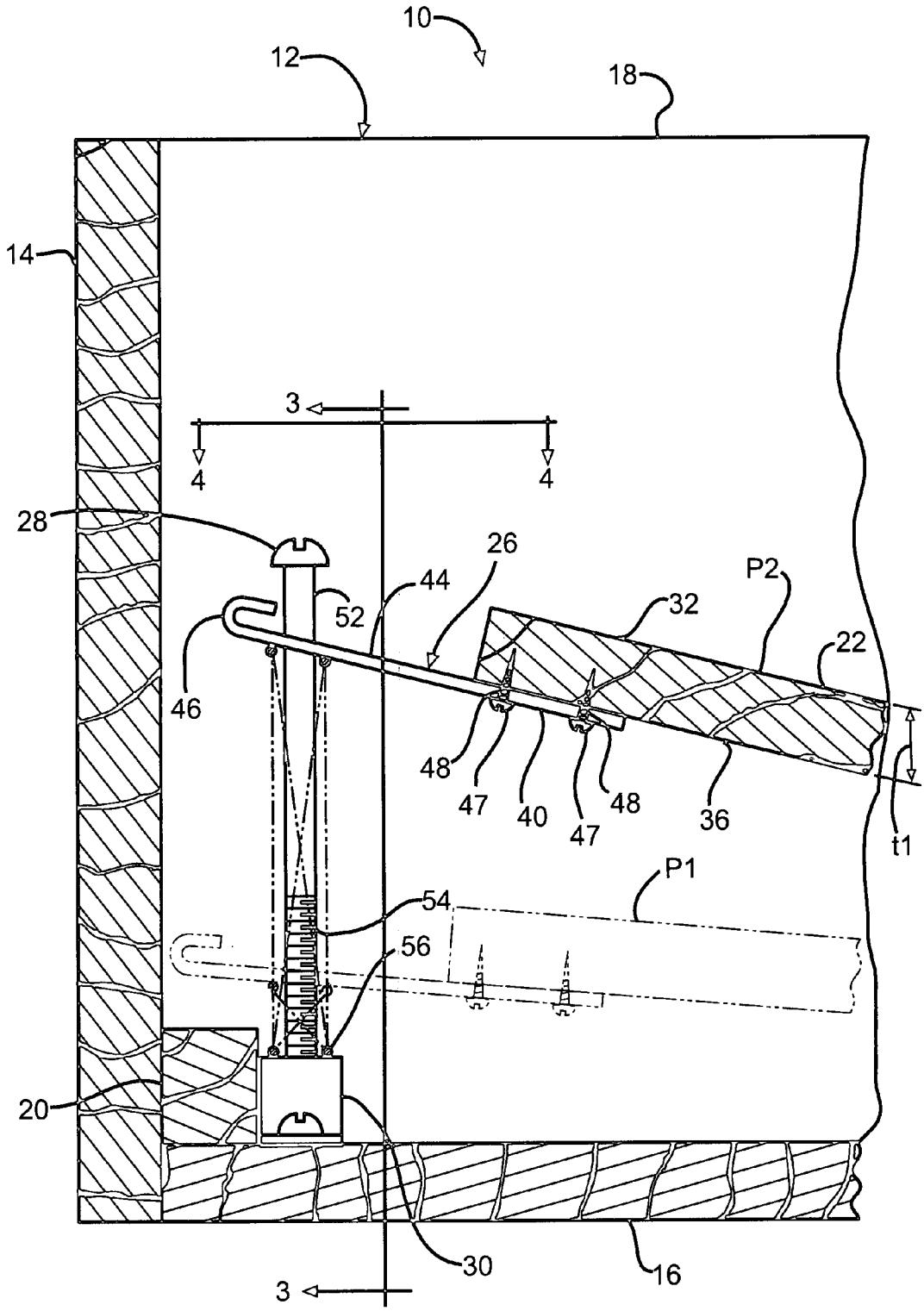
FIG. 2 is an expanded front view, partially in cross section, of a portion of the casket leveling bed.

Referring to FIGS. 1 and 2, a casket leveling bed 10 is positioned within a casket, indicated generally at 12. The casket 12 has a left side 14, a bottom 16, a back 18 and a plurality of joint rails 20.

Referring again to FIGS. 1 and 2, the casket leveling bed 10 includes a support member 22, a support stop 24, a spring member 26, a post 28, and a post bracket 30.

Referring to FIG. 2, the support member 22 is configured to support the weight of the upper torso and head of the displayed body and has a thickness t1. In this embodiment, the thickness t1 is approximately ½ inch. In another embodiment, the thickness t1 can be more or less than ½ inch. In the illustrated embodiment, the support member 22 is made of particleboard. In another embodiment, the support member 22 can be made of other materials. Referring again to FIG. 1, the support member 22 has a first end 32 and a second end 34. The first end 32 of the support member 22 includes a lower surface 36. Optionally, the support member 22 can be covered with padding and fabric (not shown) for a desired presentation of the deceased within the casket 12.

As shown in FIG. 1, the support stop 24 is attached to the bottom 16 of the casket 12. The support stop 24 includes a pivot surface 38 against which the second end 34 of the support member 22 is butted. In this embodiment, the support stop 24 is a wood rail, having a substantially rectangular cross-sectional shape and extending substantially perpendicular across the bottom 16. In another embodiment, the support stop 24 can be made of another material and can have another cross-sectional shape sufficient to provide a pivot surface 38 against which the second end 24 of the support member 22 is butted. In operation, as the second end 34 of the support member 22 pivots against the pivoting surface 38 of the support stop 24, the first end 32 of the support member 22 is raised from a level position P1 to a raised position P2.

Referring to FIGS. 1 and 2, the casket leveling bed 10 includes a spring member 26. The spring member 26 is configured to move relative to the post 28 and flex against the post 28 when the support member 22 is in the raised position P2 as will be explained in more detail later. In this embodiment, the spring member 26 is made of spring steel. In another embodiment, the spring member 26 can be made of another material, such as for example a polymer, sufficient to flex as will be explained. The spring member 26 includes an attachment section 40, a latch section 44 and a handle section 46. In this embodiment, the attachment section 40 of the spring member 26 is substantially flat and attaches to the lower surface 36 of the first end 32 of the support member 22. One or more fastening devices 47 attach the attachment section 40 to the lower surface 36 through corresponding apertures 48 in the attachment section 40. In the illustrated embodiment, the fastening devices 47 are wood screws. Alternatively, the fastening devices 47 can be other fastening mechanisms, such as for example clips, clamps or adhesives, sufficient to attach the attachment section 40 to the lower surface 36 of the first end 32 of the support member 22.

Figure 4:
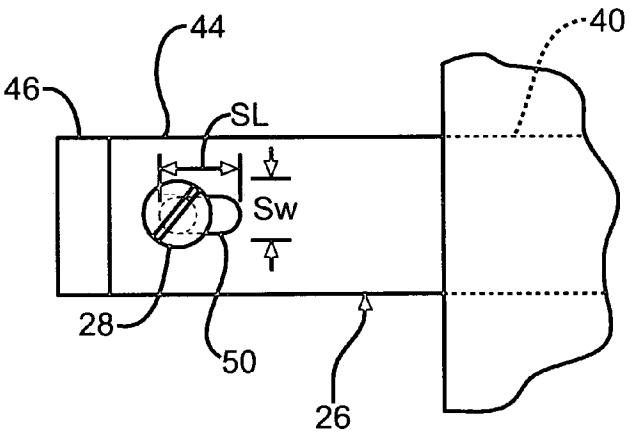
FIG. 4 is a plan view taken along line 4-4 of FIG. 2.

As further shown in FIGS. 1, 2, and 4, the spring member 26 includes latch section 44. As best shown in FIG. 4, the latch section 44 includes slot 50. Slot 50 has a slot width Sw and a slot length SL. As will be explained later in more detail, the slot 50 is configured to receive the post 28 and allow the spring member 26 to flex against the post 28.

As shown in FIGS. 1 and 2, the spring member 26 includes handle section 46. The handle section 46 is configured to allow a user to grip the spring member 26 to raise and lower the support member 22. In the illustrated embodiment, the handle section 46 has an arcuate cross-sectional shape. In another embodiment, the handle section 46 can have other cross-sectional shapes, such as for example a flat cross-sectional shape, sufficient to allow a user to grip the spring member 26 to raise and lower the support member 22.

Referring again to FIGS. 1-3, the post 28 includes a post shaft 52 and a post attachment section 54. The post shaft 52 slides within the slot 50 of the spring arm 26. The post shaft 52 further provides vertical support for the support member 22 when the support member 22 is pivoted to the raised position P2. In the illustrated embodiment, the post 28 is a machine screw and the post shaft 52 is the unthreaded portion of the machine screw. In another embodiment, the post 28 can be other structures or devices, such as for example a rod, sufficient to slide within the slot 50 of the spring arm 26 and provide vertical support for the support member 22 when the support member 22 is rotated to the raised position P2.

Figure 3:
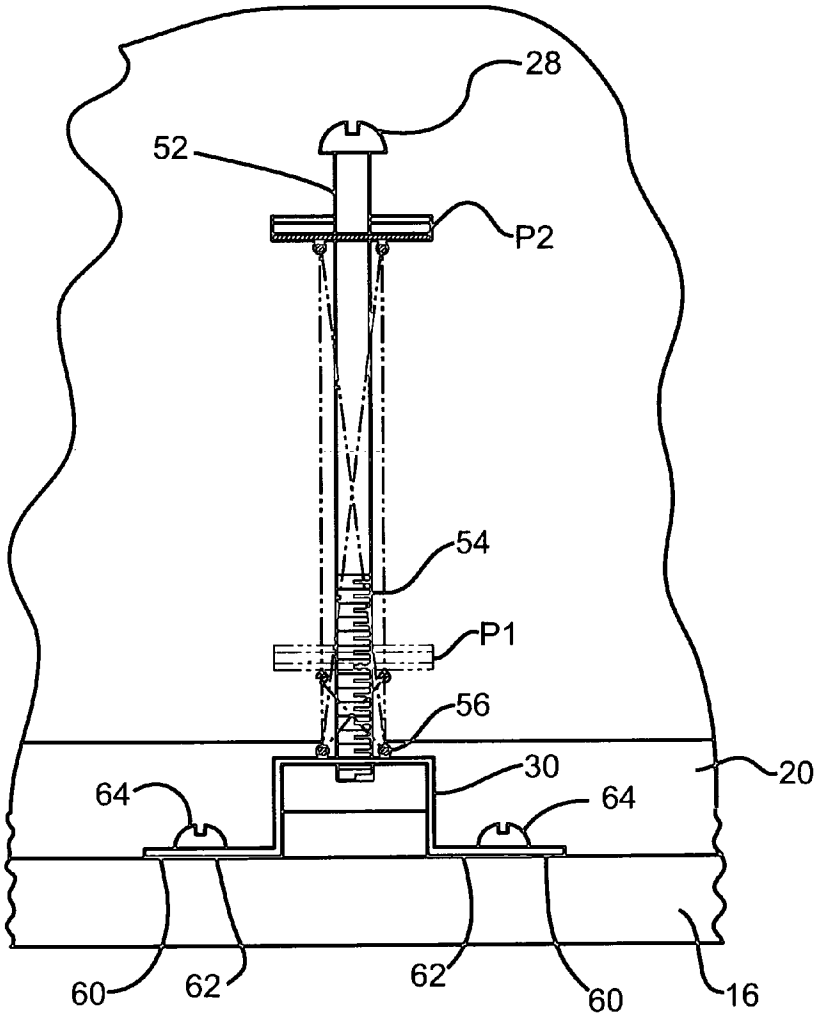
FIG. 3 is a cross-sectional view taken along line 3-3 of FIG. 2.

As shown in FIGS. 1-3, the post attachment section 54 of the post 28 attaches to the post bracket 30. In the illustrated embodiment, the post attachment section 54 is the threaded portion of the post 28. The attachment section 54 threads into a threaded aperture 56 in the post bracket 30. In another embodiment, the post 28 can be attached to the post bracket 30 in another manner.

As shown in FIG. 3, the post bracket 30 includes mounting flanges 60. The mounting flanges 60 include one or more mounting apertures 62. The post bracket is attached to the casket bottom 16 by mounting screws 64. In another embodiment, the post bracket 30 can be attached to the casket bottom 16 by other devices, such as for example clips, clamps or adhesives.

In operation, the casket leveling bed 10 is initially in level position P1. The body of the displayed body is positioned within the casket 12. The head and torso of the body are positioned on the support member 22 such that the head is at the first end 32 of the support member 22. To facilitate viewing of the deceased, the handle section 46 of the spring member 26 is raised. Raising the handle section 46 to raised position P2 causes the second end 34 of the support member 22 to pivot against the pivot surface 38 of the support stop 24. Once the support member 22 is in raised position P2, the weight of the displayed body causes the spring member 26 to flex at the slot 50. Flexing of the spring member 26 at the slot 50 causes the spring member 26 to wedge against the post shaft 52 thereby securely holding the support member 22 in raised position P2. The support member 22 can be lowered from raised position P2 by further raising the handle section 46 to disengage the spring member 26 from the post shaft 52.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

I claim:

1. A casket leveling bed assembly for positioning within a casket, the casket leveling bed assembly comprising:

a support member having a first end and a second end, the support member being pivotable allowing the first end of the support member to be raised from a level position to a raised position;

a support stop is in contact with the second end of the support member;

a spring member is attached to the first end of the support member, the spring member being flexed when the first end of the support member is in the raised position; and a post for supporting the flexed spring member in the raised position.

2. The casket leveling bed assembly of claim 1, wherein the support member has a thickness of about ½ inch.

3. The casket leveling bed assembly of claim 1, wherein the support stop is attached to a bottom of the casket.

4. The casket leveling bed assembly of claim 1, wherein the support stop includes a pivot surface.

5. The casket leveling bed assembly of claim 4, wherein the second end of the support member butts against the pivot surface of the support stop.

6. The casket leveling bed assembly of claim 5, wherein the second end of the support member pivots against the pivot surface of the support stop.

7. The casket leveling bed assembly of claim 1, wherein the support stop extends substantially perpendicular across the bottom of the casket.

8. The casket leveling bed assembly of claim 1, wherein the spring member is made of steel.

9. The casket leveling bed assembly of claim 1, wherein the spring member includes a latch section, the latch section includes a slot.

10. The casket leveling bed assembly of claim 9, wherein the slot receives the post.

11. The casket leveling bed assembly of claim 10, wherein the post includes a post shaft.

12. The casket leveling bed assembly of claim 11, wherein the post shaft slides within the slot.

13. The casket leveling bed assembly of claim 1, wherein the post includes a threaded portion.

14. The casket leveling bed assembly of claim 1, wherein the post is attached to a post bracket.

15. The casket leveling bed assembly of claim 14, wherein the post bracket is attached to a bottom of the casket.

* * * * *